US007938132B2

(12) United States Patent
Li

(10) Patent No.: US 7,938,132 B2
(45) Date of Patent: May 10, 2011

(54) VEHICLE CANOPY

(76) Inventor: Wanda Ying Li, Santa Ana, CA (US)

( * ) Notice: Subject to any disclaimer, the term of this patent is extended or adjusted under 35 U.S.C. 154(b) by 12 days.

(21) Appl. No.: 11/583,247

(22) Filed: Oct. 18, 2006

(65) Prior Publication Data

US 2007/0079856 A1 Apr. 12, 2007

(30) Foreign Application Priority Data

Nov. 1, 2005 (CN) ..... 2005 2 0035950 U

(51) Int. Cl.
*E04H 15/10* (2006.01)

(52) U.S. Cl. ..... 135/91; 135/94; 135/160

(58) Field of Classification Search ..... 135/114, 135/115, 117, 120.2, 120.1, 121, 157, 158, 135/91, 93, 94
See application file for complete search history.

(56) References Cited

U.S. PATENT DOCUMENTS

| | | | | | |
|---|---|---|---|---|---|
| 590,706 | A * | 9/1897 | Lentz et al. | ..... | 160/54 |
| 1,820,412 | A * | 8/1931 | Warren | ..... | 135/119 |
| 1,828,656 | A * | 10/1931 | Handler | ..... | 135/149 |
| 4,231,289 | A * | 11/1980 | Domicent | ..... | 454/52 |
| 4,265,261 | A * | 5/1981 | Barker | ..... | 135/100 |
| 5,000,211 | A * | 3/1991 | Speare et al. | ..... | 135/97 |
| 5,193,327 | A * | 3/1993 | Goodenberger | ..... | 52/747.1 |
| 6,273,114 | B1 * | 8/2001 | Schaefer | ..... | 135/128 |
| 6,662,816 | B1 * | 12/2003 | Cunningham | ..... | 135/94 |
| 6,679,277 | B2 * | 1/2004 | Choi | ..... | 135/93 |
| 6,701,948 | B2 * | 3/2004 | Jopp et al. | ..... | 135/97 |
| 7,216,657 | B2 * | 5/2007 | Choi | ..... | 135/93 |
| 7,341,070 | B1 * | 3/2008 | Wallace | ..... | 135/117 |
| 2003/0029490 | A1 * | 2/2003 | Price et al. | ..... | 135/131 |
| 2007/0094947 | A1 * | 5/2007 | Greenfeld et al. | ..... | 52/79.1 |
| 2008/0017231 | A1 * | 1/2008 | Chen | ..... | 135/121 |

* cited by examiner

*Primary Examiner* — David Dunn
*Assistant Examiner* — Noah Chandler Hawk
(74) *Attorney, Agent, or Firm* — Raymond Y. Chan; David and Raymond Patent Firm

(57) ABSTRACT

A vehicle canopy includes a canopy frame defining a canopy area therein. A front cloth panel, a rear cloth panel and two side cloth panels are connected with each other to form a canopy cloth structure to cover the canopy frame so as to normally conceal the canopy area within the canopy frame. One of the front and rear cloth panels provides a door for entrance and exit and the side cloth panels provide side doors which are constructed to be selectively closed or opened for facilitating entrance and exit. The top canopy provides a plurality of ventilating skylights constructed to be selectively closed or opened for allowing air passing therethrough for ventilating the canopy area via the ventilating skylights. In addition, the height of the vehicle canopy is constructed to be adjustable.

2 Claims, 4 Drawing Sheets

VEHICLE CANOPY

BACKGROUND OF THE PRESENT INVENTION

1. Field of Invention

The present invention relates to a canopy, and more particularly to a vehicle canopy.

2. Description of Related Arts

A canopy can be used in a specific place such as in villas, beaches, hotels, apartments etc for vehicle. Although different kinds canopy for vehicle with different shapes are available but most of them contain the following drawbacks. First, the wind-proof ability is bad. Especially when it is used in windy days, the cloth could easily be rolled up. Second, since the height of the canopy is not adjustable, it is not convenient for people to use. Third, most conventional canopies do not contain any lighting system for use.

SUMMARY OF THE PRESENT INVENTION

A main object of the present invention is to provide a vehicle canopy which is easier to use while providing better windproof ability, mechanism for height adjustment and lighting arrangement for illumination.

Accordingly, in order to accomplish the above objects, the present invention provides a vehicle canopy comprising front, rear and side cloth panels, a top canopy, a roof frame, a lighting arrangement, transverse bars, standing posts, and mounting plates. The roof frame comprises a plurality of inclined bars connected with a plurality top bars by means of a plurality of three-way connectors and four-way connectors, wherein the roof frame, transverse bars, and the mounting plates construct a canopy frame and the mounting plates are installed at lower portions of the standing posts in such a manner that the mounting plates are adjustable up and down in order to adjust the height of the vehicle canopy.

The front, rear and side cloth panels and the top canopy are connected with each other to form a canopy cloth structure to cover the canopy frame so as to normally conceal a canopy area within the canopy frame.

The top canopy provides a plurality of ventilating skylights constructed to be selectively opened for allowing air passing therethrough for effectively ventilating the canopy area via the ventilating skylights or closed to prevent the canopy from rolling up in the windy days.

The side cloth panels provide side doors which are constructed to be selectively opened by rolling up the cloth door panel for facilitating the entrance and exit of the users. The front, rear or side cloth panels provides one or more windows for ventilation, which are constructed to be selectively opened by up rolling window cloth panels thereof to enable the sunshine entering the canopy area within the vehicle canopy or closed to prevent insects such as mosquitoes from entering the canopy area. The front and rear cloth panels may also provide door for entrance and exit convenient.

Each window provided on the front, rear, side cloth panels is covered with an inner transparent PVC cloth provided thereon by stitching, for example, while the window cloth panel is sheltered outside the PVC cloth and constructed to be capable of rolling up to open the window.

Alternatively, each window provided on the front, rear, side cloth panels is covered with an air ventilating fabric panel provided thereon by stitching, for example, while the window cloth panel is sheltered outside the air ventilating fabric panel and constructed to be capable of rolling up to open the window.

The side doors are connected with the side cloth panels by zippers and the front and rear door on the front and rear cloth panels are also connected thereon by zippers.

Each of the mounting plates has a positioning hole and each of the standing posts has three ellipse securing holes, wherein each standing post can be connected to the respective mounting plate by a bolt and nut connection through the positioning hole aligned with one of the securing holes so that the height of the standing posts as well as the vehicle canopy can thus be adjusted by selectively aligning positioning hole with an upper or lower securing holes for connection.

Each of the ventilating skylights comprises an air ventilating cloth sewed to cover a skylight opening provided on the top canopy to prevent insects from entering therethough while enabling air passing through and enforcing the strength of top canopy, a skylight cloth cover attached to the top canopy for selectively covering or opening the skylight opening and the ventilating cloth, and a skylight supporting bar for supporting the skylight cloth cover to control the size of the skylight opening of the ventilating skylight to be opened.

Accordingly, the present invention substantially achieves the following advantages in comparison with the conventional vehicle canopy:

(1) better wind-proof ability that can prevent the canopy panel from rolling up in windy days;

(2) the height of the vehicle canopy being adjustable that facilitates the user to operate conveniently;

(3) providing ventilating skylights, windows, front and rear doors, and side doors to provide a more user friendly vehicle canopy;

(4) convenient in assembly and operation; and (5) easier to manufacture and lower manufacturing cost.

These and other objectives, features, and advantages of the present invention will become apparent from the following detailed description, the accompanying drawings, and the appended claims.

DETAILED DESCRIPTION OF THE PREFERRED EMBODIMENT

Figure 1:
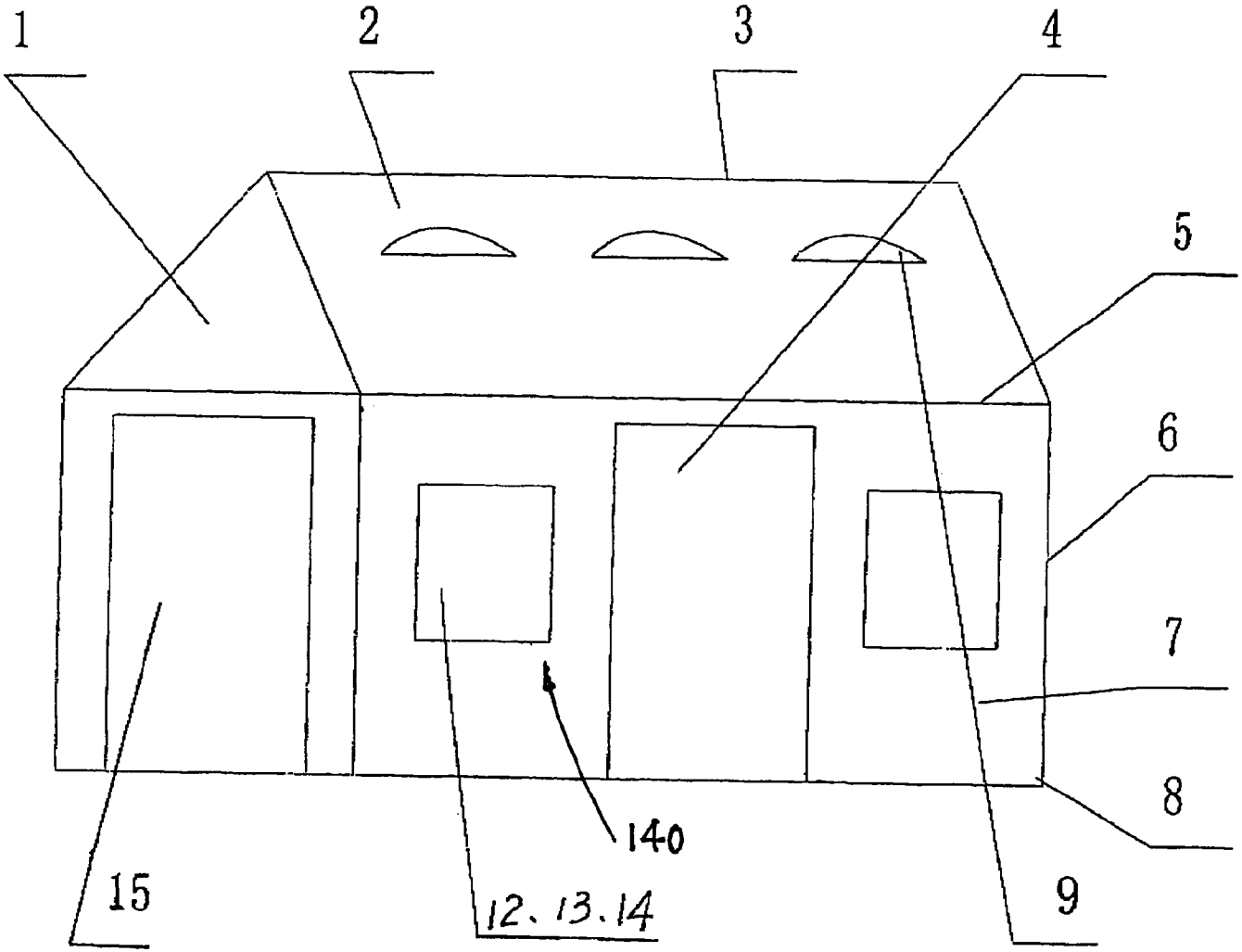
FIG. 1 is a schematic view of a vehicle canopy according to a preferred embodiment of the present invention.
Figure 2:
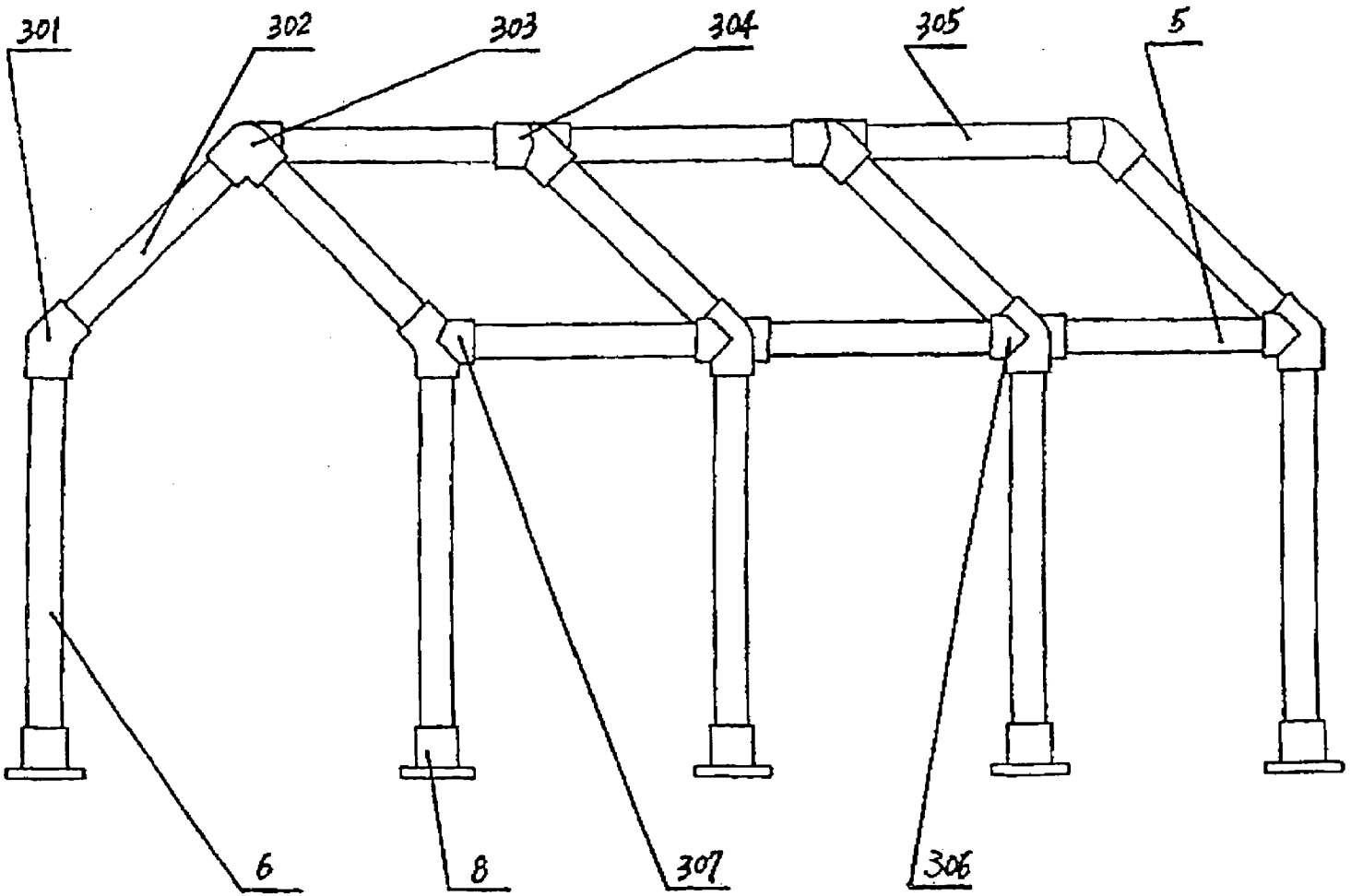
FIG. 2 is a perspective view of the canopy frame according to the above preferred embodiment of the present invention.
Figure 3:
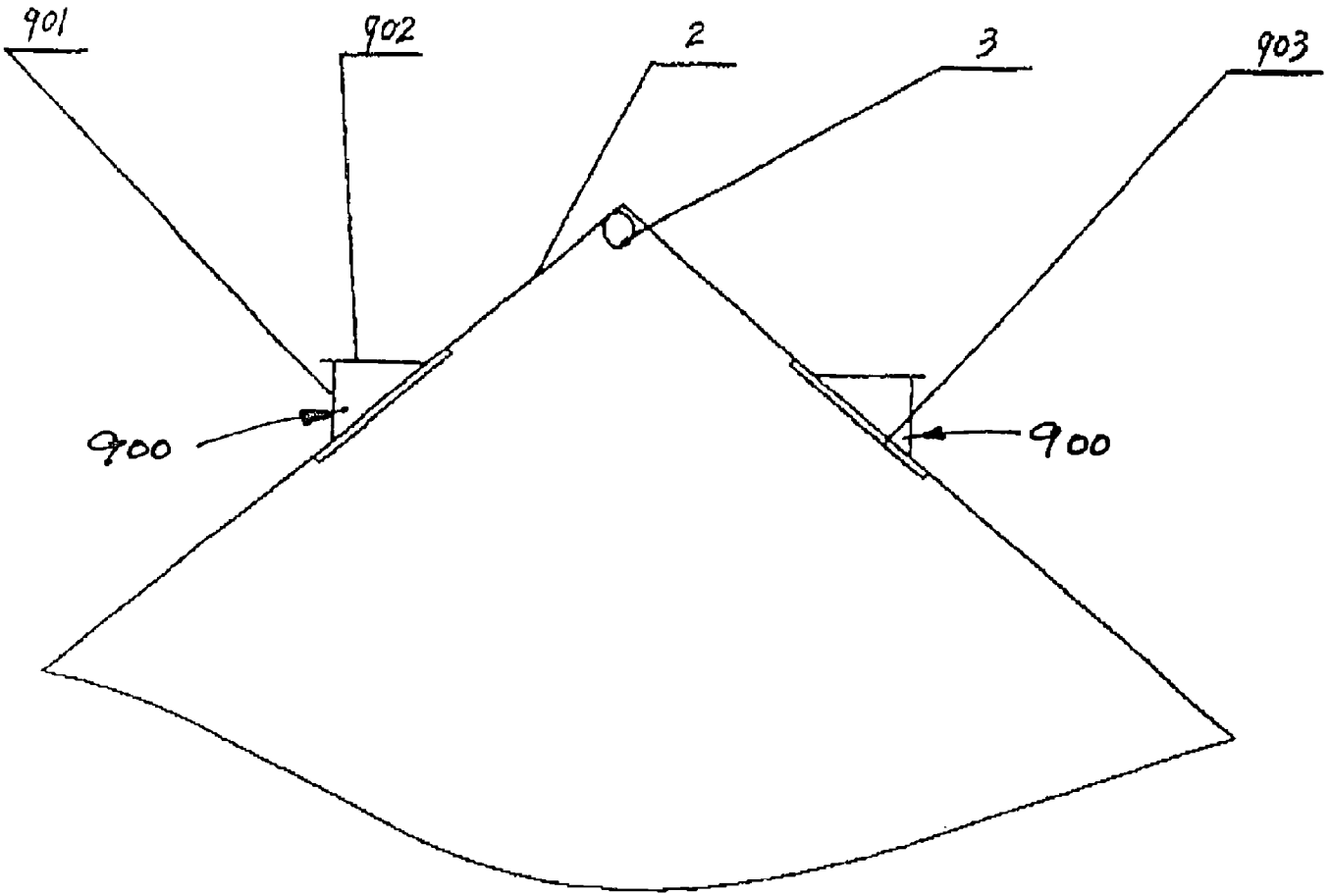
FIG. 3 is a perspective view of the ventilating skylights provided on the top canopy according to the above preferred embodiment of the present invention.
Figure 5:
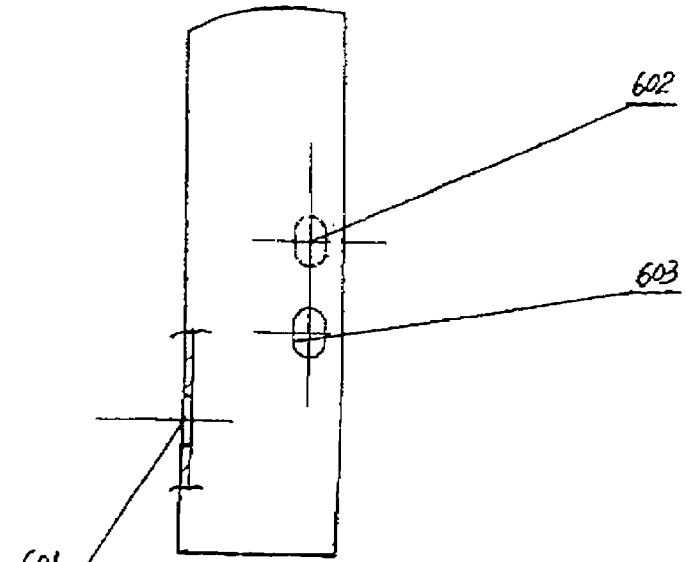
FIG. 5 is an elevation view of the connecting portion of the standing post as shown in FIG. 4 according to the above preferred embodiment of the present invention.
Figure 6:
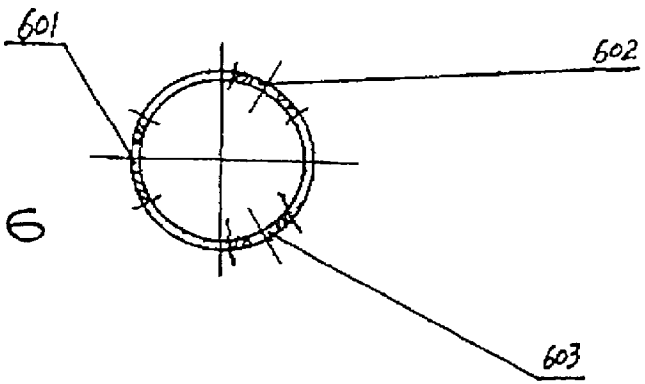
FIG. 6 is a sectional plan view of the standing post as shown in FIG. 5 according to the above preferred embodiment of the present invention.
Figure 4:
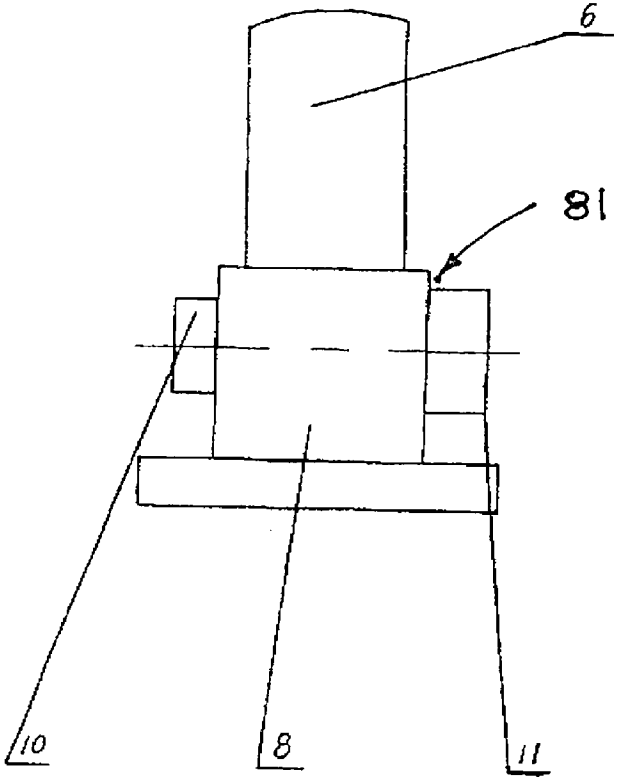
FIG. 4 is a schematic view illustrating the connection joint structure of the mounting plate and the standing post according to the above preferred embodiment of the present invention.

Referring to FIG. 1 of the drawings, the present invention provides a vehicle canopy which comprises front and rear cloth panels 1, a top canopy 2, a roof frame 3, a side doors 4, transverse bars 5, standing posts 6, side cloth panels 7, and mounting plates 8 as shown in FIG. 2. The roof frame 3 comprises left three-way connectors 301, a plurality of inclined bars 302, top three-way connectors 303, top four-way connectors 304, a plurality of top bars 305, middle four-way connectors 306, and right three-way connectors 307 connected with each other to form the roof frame 3. To assemble, the inclined bars 302 and transverse bars 305 are inserted in the respective three-way and four-way connectors to form the roof frame 3, wherein the top bars 305 and the standing posts 6 are inserted in the respective the three-way and four-way connectors to form the canopy frame as shown in FIG. 2.

The front and rear cloth panels 1, the top canopy 2 and the side cloth panels 7 are connected together by sewing, zippers or hook and loop fasteners to form a canopy cloth structure to cover the canopy frame so as to normally conceal a canopy area within the canopy frame.

The top canopy 2 provides a plurality of ventilating skylights 9 constructed to be selectively opened for allowing air passing therethrough for effectively ventilating the canopy area via the ventilating skylights 9 or closed to prevent the canopy from rolling up in windy days. Each of the ventilating skylights 9 comprises an air ventilating cloth 903 sewed to cover skylight opening 900 of the ventilating skylight 9 to prevent insects from entering therethough while enabling air passing through and enforcing the strength of top canopy 2. Each ventilating skylight 9 further comprises a skylight cloth cover 902 attached to the top canopy 2 for selectively covering or opening the skylight opening 900 and the ventilating cloth 903 and a skylight supporting bar 901 which is used to support the skylight cloth cover 902 to control the size of the skylight opening 900 of the ventilating skylight 9 to be opened.

The mounting plates 8 are installed at lower portions of the standing posts 6 respectively. Each of the mounting plates 8 has a positioning hole 81 and each of the standing posts 6 has three elliptic securing holes 601, 602, 603, wherein each standing post 6 can be connected to the respective mounting plate 8 by means of a bolt 10 and a nut 11 connection through the positioning hole 81 aligned with one of the securing holes 601, 602, 603 so that the height of the standing posts 6 as well as the vehicle canopy can thus be adjusted by selectively aligning positioning hole 81 with one of the upper or lower securing holes 601, 602, 603 for connection.

The front, rear or side cloth panels 1, 7 provides one or more windows 140 for ventilation, which are constructed to be selectively opened by up rolling window cloth panels 14 thereof to enable the sunshine entering the canopy area within the vehicle canopy or closed to prevent insects such as mosquitoes from entering the canopy area. Each window 140 provided on the front, rear, side cloth panels 1, 7 is covered with an inner transparent PVC cloth 12 provided thereon by stitching, for example, while the window cloth panel 14 is sheltered outside the PVC cloth 12 and constructed to be capable of rolling up to open the window 14.

Alternatively, each window 140 provided on the front, rear, side cloth panels 1, 7 is covered with an air ventilating fabric panel 13 provided thereon by stitching, for example, while the window cloth panel 14 is sheltered outside the air ventilating fabric panel 13 and constructed to be capable of rolling up to open the window 140.

The front and rear cloth panels 1 each provides a door 15 for entrance and exit convenient. The side cloth panels 7 provide the side doors 4 which are cloth door panels constructed to be selectively rolling up to open for facilitating the entrance and exit of the users. The side doors 4 are connected with the side cloth panels 7 by zippers and the front and rear door 15 on the front and rear cloth panels 1 are also connected thereon by zippers.

Accordingly, the present invention substantially achieves the following advantages in comparison with the conventional vehicle canopy:

(1) better wind-proof ability that can prevent the canopy panel from rolling up in windy days;

(2) the height of the vehicle canopy being adjustable that facilitates the user to operate conveniently;

(3) providing ventilating skylights, windows, front and rear doors, and side doors to provide a more user friendly vehicle canopy;

(4) convenient in assembly and operation; and (5) easier to manufacture and lower manufacturing cost.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vehicle canopy, comprising:

a canopy frame defining a canopy area therein, wherein said canopy frame comprises a roof frame, a plurality of standing posts supporting said roof frame and a plurality of mounting plates constructed to respectively connect with selective positions of lower portions of said standing post, so that a height of said vehicle canopy is able to be adjusted, wherein said roof frame comprises a plurality of top bars and a plurality of inclined bars, a plurality of transverse bars connected with said inclined bars respectively, and a plurality of standing posts supporting said roof frame, wherein said roof frame further comprises a plurality of left three-way connectors, a plurality of three-way connectors, a plurality of four-way connectors, a plurality of middle four-way connectors, and a plurality of right three-way connectors, wherein said inclined bars and said transverse bars are inserted in said respective three-way and four-way connectors to form said roof frame, wherein said top bars and said standing posts are inserted in said respective three-way and four-way connectors to form said canopy frame;

a front cloth panel;

a rear cloth panel;

two side cloth panels connected said front cloth panel and said rear cloth panel to form a canopy cloth structure to cover said canopy frame so as to normally conceal said canopy area within said canopy frame, wherein of said front and rear cloth panels provides a front and rear doors respectively for entrance and exit, wherein said front and rear doors are connected to said front and rear cloth panels by zippers, and said side cloth panels provide at least one side door which is constructed to be selectively closed or opened for facilitating entrance and exit to said canopy area, wherein said side door is connected with said side cloth panels by zippers, and is constructed to be capable of selectively rolling up to open for said entrance and exit of said vehicle canopy;

one or more windows being provided on at least one of said front, rear, and side cloth panels for ventilation, wherein each of said windows comprise a window cloth panel affixed to at least one of said front, rear, and side cloth panels and being constructed to be selectively opened by rolling up said window cloth panel for enabling sunshine entering said canopy area within said vehicle canopy and to be selectively closed for preventing insects entering said canopy area, wherein each said window further comprises an inner panel being stitched on at least one of said front, rear, and side cloth panels and being sheltered by said window cloth panel, wherein said inner panel is selected from the group consisting of inner transparent PVC cloth and an air ventilating fabric panel; and a top canopy provided on top of said front cloth panel, said rear cloth and said side cloth panels, wherein said top canopy has a plurality of ventilating skylights spacedly provided thereon, and constructed to be selectively closed and opened for allowing air passing therethrough for ventilating said canopy area via said ventilating skylights, wherein each of said ventilating skylights comprises an air ventilating cloth connected to cover a skylight opening provided on said top canopy, a skylight cloth cover attached to said top canopy for selectively covering and opening said skylight and said ventilating cloth, and means for supporting said skylight cloth cover to control a size of said skylight opening of said respective ventilating skylight to be opened, wherein said supporting means comprises a skylight supporting bar which supports said skylight cloth cover to control the size of said skylight opening of said ventilating skylight to be opened.

2. The vehicle canopy, as recited in claim 1, wherein each of said mounting plates has a positioning hole while each of said standing posts has three securing holes, wherein each said standing post is able to be connected to said respective mounting plate through said positioning hole aligning with one of said securing holes so that a height of said vehicle canopy is able to be adjusted by selectively aligning said positioning hole with one of said upper and lower securing holes for connection, wherein said top canopy is substantially supported through said top bars and said inclined bars.

* * * * *